US006416290B1

(12) United States Patent
Yamauchi

(10) Patent No.: US 6,416,290 B1
(45) Date of Patent: Jul. 9, 2002

(54) TURBO MOLECULAR PUMP

(75) Inventor: Akira Yamauchi, Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/355,196

(22) PCT Filed: Jan. 21, 1998

(86) PCT No.: PCT/JP98/00218

§ 371 (c)(1),
(2), (4) Date: Oct. 4, 1999

(87) PCT Pub. No.: WO98/32972

PCT Pub. Date: Jul. 30, 1998

(30) Foreign Application Priority Data

Jan. 22, 1997 (JP) ..... 9-021909
Jan. 14, 1998 (JP) ..... 10-017741

(51) Int. Cl.[7] ..... F04B 49/00; F04B 39/04

(52) U.S. Cl. ..... 417/32; 417/423.4; 417/228; 415/118

(58) Field of Search ..... 417/32, 2, 44.1, 417/243, 286, 423.4, 63, 228; 415/47, 48, 90, 118

(56) References Cited

U.S. PATENT DOCUMENTS 5,618,167 A * 4/1997 Hirakawa et al. ..... 417/423.4
5,879,139 A * 3/1999 Hayashi et al. ..... 417/292
6,056,510 A * 5/2000 Miura et al. ..... 417/2
6,123,522 A * 9/2000 Kubo et al. ..... 417/423.4

FOREIGN PATENT DOCUMENTS

JP 1267301 A * 10/1989 ..... 415/90
JP 3290092 A * 12/1991 ..... 415/90
JP 4017797 A * 1/1992 ..... 415/90

* cited by examiner

*Primary Examiner*—Charles G. Freay
(74) *Attorney, Agent, or Firm*—Adams & Wilks

(57) ABSTRACT

To reduce losses by exerting the exhaustion performance to the full extent when a temperature of a rotor blade is within an allowable value, and to lower a variation in an r.p.m. of a turbomolecular pump even with a change in the gas load to maintain the exhaustion performance. Further to prevent deterioration of the rotor blade caused by a heat generation when a temperature of a rotor blade exceeds an allowable value.

A driver output set r.p.m. determining unit 5 determines a driver output which can be exerted to the maximum or a set r.p.m., in response to signals of rotor blade temperature sensor 1, an r.p.m. sensor 2, a motor current sensor 3, and an axial electromagnet current sensor 4 when the temperature of the rotor blade is within an allowable value. A driver output switching unit 6 changes over a turbomolecular pump driving output of a motor driver 8, in response to the signal of the driver output set r.p.m. determining unit 5. Further, an r.p.m. compensating unit 7 changes a driving r.p.m. of a turbomolecular pump.

19 Claims, 12 Drawing Sheets

FIG,12
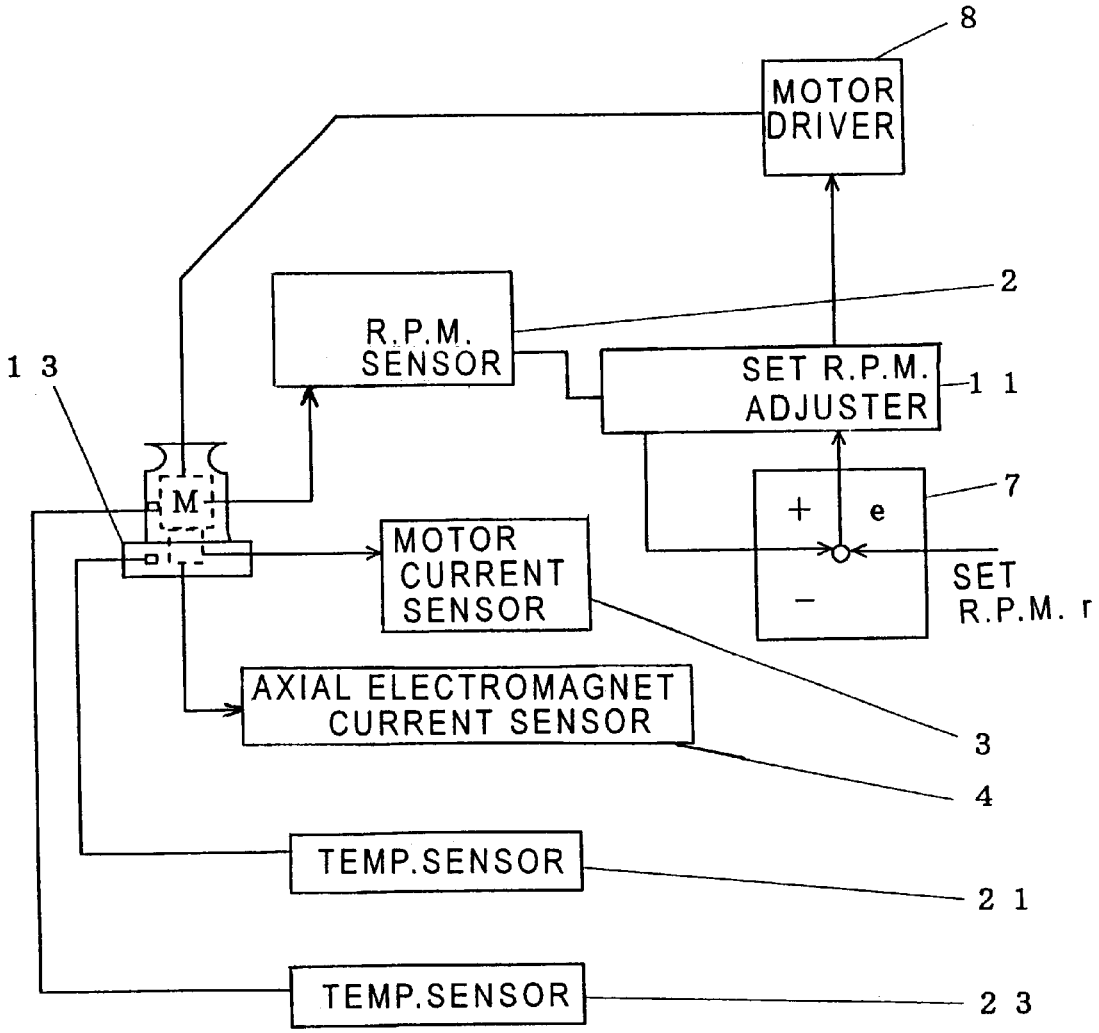
PRIOR ART

TURBO MOLECULAR PUMP

TECHNICAL FIELD

The present invention relates to a turbomolecular pump, and more specifically, to a turbomolecular pump in which a temperature of a rotor blade can be detected, thereby making it possible to prevent an abnormal increase in the temperature of the rotor blade, as well as to prevent the deposition thereon of generated products, to increase pressure upon baking, to provide an alarm of the extraordinary operation of the rotor blades, and to improve the exhaustion performance.

BACKGROUND ART

A turbomolecular pump is a vacuum pump in which rotor blades rotating at high speed and having blades at plural stages, which are divided in a circumferential direction, impart a certain momentum to a gas molecule impinging upon the surface thereof, to transport the gas. This type of pump is also used as a part of semiconductor manufacturing equipment.

Conventionally, when a turbomolecular pump is used to discharge an active gas or the like, a reaction with the active gas may cause generated products to be solidified or adhered. These generated products described above were in a state liable to solidify or adhere particularly when the temperature was low around the exhaust port. Therefore, as shown in FIG. 12, a temperature sensor 21 (e.g., thermistor) is embedded in a base portion 13, and is managed so that a temperature of the base portion 13 is kept constant in response to signals of the temperature sensor 21 (hereinafter referred to as TMS: Temperature Management System).

Degassing (hereinafter referred to as baking) from the turbomolecular pump, a piece of semiconductor manufacturing equipment and from a pipe connected therewith are carried out under such a state that they are heated to a certain temperature for a certain time period before the turbomolecular pump is operated. Thereafter, when the temperature is returned to an ordinary temperature, the degree of vacuum at a portion of an inlet port of the turbomolecular pump and an inside of a chamber may be increased (a so-called utmost pressure will be increased).

In addition, as shown in FIG. 12, the conventional turbomolecular pump includes a motor M driven by a motor driver 8 that is equipped with an r.p.m. sensor 2 for detecting an r.p.m. of the motor M, a motor current sensor 3 for detecting a current of the motor M, and an axial electromagnet current sensor 4 for detecting a current of an axial electromagnet causing the rotor blade to magnetically float.

An r.p.m. comparator 7 is connected to the r.p.m. sensor 2, and outputs a difference between an output of the r.p.m. sensor 2 and a set r.p.m. to the motor driver 8 via a set r.p.m. adjuster 11. With such an arrangement, the r.p.m. of the motor pump can be controlled.

Meanwhile, if the temperature of the rotor blade exceeds a long-term allowable heat-resistant temperature (e.g., 150° C. when a material of the rotor blade is aluminum alloy), there is a concern that the strength of the rotor blade may particularly be lowered because of damage caused by heat generation, resulting in breaking the turbomolecular pump in the worst case.

Generally, when an output of the motor driver 8 is large (a maximum level of the current is made large, and is rated at 500 W, for example), this large output (because of output allowances) allows the r.p.m. not to be reduced even when a gas load is made larger. However, on the other hand, heat generation at the rotor blade becomes larger, with the result that the rotor blades deteriorate or are lowered in their strength due to the heat generation.

To cope with this, the output of the motor driver 8 was typically lowered to, e.g., 400 W to be set, and if the gas load exceeds an allowable value, the r.p.m. of the rotor blades is slightly lowered from the allowable rating. As a result, deterioration of the rotor blades caused by heat generation could be prevented.

In addition, an allowable flow rate is experimentally calculated, and determined so that the temperature of the rotor blade may be set within the allowable value even when the turbomolecular pump is operated for a certain time period.

In addition, in order to prevent an abnormal increase in the temperature of the rotor blade, a temperature sensor 23 (e.g., thermistor) is disposed in the vicinity of the motor M. When the temperature sensor 23 senses a certain level or more in the temperature, the turbomolecular pump is caused to stop immediately.

However, the conventional apparatus does not monitor the temperature of the rotor blade, and there are such disadvantages as will be described below. That is, the higher a set temperature of the TMS that is set, the smaller the deposition of generated products, so that the set temperature is preferably set as high as possible. If the set temperature is set as high, however, the temperature is elevated around the rotor blade, and heat radiation is prevented at the rotor blade. This results in a higher temperature of the rotor blade, a shorter lifetime of the rotor blade, a breakage, etc. Accordingly, there is a limit on increasing the set temperature of the TMS.

Further, similarly, if baking is carried out at a higher temperature, the utmost pressure is further improved, so that baking is preferably carried out at a temperature as high as possible. When baking is carried out at an excessively high temperature, however, the temperature of the rotor blade is elevated, and the heat generation may cause the lifetime of the rotor blade to be shortened.

In addition, even in the case where the temperature of the rotor blade is lower than an allowable heat-resistive temperature (within a sufficient allowance), if the turbomolecular pump is used under a reduced driver-output, the r.p.m. of the rotor blade is lowered (e.g., from normal 35,000 rpm to 33,000 rpm) with an increase of the gas load, thereby causing the exhaustion or exhaust performance to be deteriorated. The exhaustion performance in this case means that the exhaustion speed is lowered or an exhaust port pressure is increased. In other words, the higher the r.p.m. of the rotor blade is, the more the exhaustion performance is enhanced.

Moreover, if the gas load abruptly changes, the r.p.m. of the rotor blade is likely to fluctuate as the driver output is low, and therefore the exhaustion speed and the inlet port pressure may not be stabilized.

Further, there is a fear that even with the reduced driver output, the rotor blade may be gradually heated to have a high temperature as a long time elapses. In any event, there has been a need for measuring the temperature of the rotor blade to prevent deterioration of the rotor blade caused by the heat generation.

The present invention has been made in view of such conventional problems, and an object of the invention is to provide a turbomolecular pump in which a temperature of a rotor blade, etc., can be measured.

Another object of the invention as set forth in claim 6 is to provide a turbomolecular pump in which deposition of generated products can be prevented more effectively than in the conventional pump.

Still another object of the invention is to provide a turbomolecular pump with an improvement in an utmost pressure by increasing the utmost pressure when baking is performed.

Yet another object of the invention is to protect a turbomolecular pump.

Still yet another object of the invention is to provide a turbomolecular pump in which the exhaustion performance is exerted to the maximum extent for reducing losses when a temperature of a rotor blade is within an allowable value, a variation in an r.p.m. of a motor pump is lowered to maintain an exhaustion speed and an inlet port pressure at constant levels even though the gas load varies, and deterioration of the rotor blade caused by heat generation can be prevented when the temperature of the rotor blade exceeds the maximum allowable value.

Another object of the invention is to provide a turbomolecular pump which is forcibly cooled around rotor blade to thereby improve the exhaustion performance (allowable gas flow rate, allowable inlet port pressure).

DISCLOSURE OF THE INVENTION

In order to attain the above-noted objects, the invention according to one aspect thereof is characterized by comprising rotor blade temperature detecting means for measuring or estimating a temperature of the rotor blade (12). Provision of the rotor blade temperature detecting means to a turbomolecular pump P allows detection of the temperature of the rotor blade (12), thereby making it possible to use this temperature to increase the lifetime of the rotor blade (12) and to prevent deterioration caused by heat generation. In this case, the rotor blade temperature detecting means includes all means capable of measuring or estimating the temperature of the rotor blade (12).

Specifically, as an example of the rotor blade temperature detecting means, according to another aspect of the invention, it is characterized in that the rotor blade temperature detecting means is provided with a thermometer (1) facing the rotor blade (12), and being capable of detecting a temperature thereof in a non-contact manner therewith, the thermometer being embedded in a base portion (13) or disposed at a flange portion of an inlet port (40). The thermometer (1), is not brought into contact with the rotor blade (12) and is embedded in the base portion (13) or disposed at the flange portion of the inlet port (40). As a result, the temperature of the rotor blade (12) can be measured without affecting a flow of gas.

Further, as another example of the rotor blade temperature detecting means according to the invention, it is characterized in that the rotor blade temperature detecting means includes temperature detecting elements **(84*a*, 84*b*, 84*c*) disposed at least one of a fixing blade (82) confronting the rotor blade (12) at a small interval, a fixing blade spacer (86) supporting one end of the fixing blade (82) and stacked step by step in a floating direction of the rotor blade (12), and a member (96) fixed to a stator (92) through at least one supporting portion (94) made of a thermally insulating material confronting a main shaft (104) of the rotor blade (12) and provided in a space formed at the rotor blade (12) side of the stator (92) one end of which is fixed to the base portion (13), and further comprises an arithmetic unit (98) for calculating and estimating a temperature of the rotor blade (12) based on the temperature detected by the temperature detecting elements (84*a*, 84*b*, 84*c*)**.

The rotor blade temperature detecting means includes temperature detecting elements **(84*a*, 84*b*, 84*c*) disposed at at least one of a fixing blade (82), a fixing blade spacer (86), and a member (96) fixed to a stator (92) through a supporting portion (94), and arithmetically estimates a temperature of the rotor blade (12) based on the detected temperature. This arithmetic can be performed, in view of thermal conductivity, heat radiation and the like, to be rendered as a theoretical value, and, in addition, by being compared with experimental data calculated in advance, or the like. The provision at the fixing blade (82) or the like can measure the temperature of the rotor blade (12)** without affecting a flow of gas in a similar manner as described above.

Further, as still another example of the rotor blade temperature detecting means according to the invention, it is characterized in that the rotor blade temperature detecting means comprises: first length measuring means for measuring lengths in a floating direction of the rotor blade (12) and calculating a variation in lengths before and after thermal expansion; second length measuring means for measuring lengths in a floating direction of a main shaft (104) of the rotor blade (12) and calculating a variation in lengths before and after the thermal expansion; and an arithmetic unit for calculating and estimating a temperature of the rotor blade (12) based on a difference between the variation in lengths by the second length measuring means and the variation in lengths by the first length measuring means.

The rotor blade (12) and the main shaft (104) of the rotor blade (12) are subjected to heat expansion according to a temperature change. Approximately, the variation in lengths can be considered substantially proportional to the temperature change. For this reason, a variation in lengths before and after thermal expansion for the rotor blade (12) is calculated, and then a variation in lengths before and after thermal expansion for the main shaft (104) of the rotor blade (12) is calculated. A difference between the both variations in lengths is calculated, and considering coefficients of the thermal expansion depending upon the materials making up of the respective parts, the temperature of the rotor blade (12) is estimated by computation. The temperature of the rotor blade (12) can therefore be measured without affecting a flow of gas described above a similar manner as in.

Further, as still another example of the rotor blade temperature detecting means according to the invention, it is characterized in that the rotor blade temperature detecting means arithmetically estimates a temperature of the rotor blade (12) based on a difference between a temperature of introduced gas at an inlet port (40) and an exhaust port (122) or based on a difference between a temperature at an entry (128) and a exit (130) of a water-cooled tube that is provided to water-cool the rotor blade (12).

The temperature of introduced gas is measured at an inlet port (40) and an exhaust port (122), to calculate a temperature difference therebetween. Or, a temperature is measured at an entry (128) and an exit (130) of a water-cooled tube that is placed close to the rotor blade (12) or around an outer casing (136) in order to water-cool the rotor blade (12), to thereby calculate a temperature difference therebetween. Based on the temperature difference, the temperature of the rotor blade (12) is then estimated by calorie computation, or by being compared with experimental data calculated in advance, or the like. A temperature of the rotor blade (12) can be therefore measured without affecting a flow of gas in a similar manner as described above.

The invention according to another aspect is characterized by comprising base temperature setting means for setting a target temperature of the base portion (13) based on the temperature of the rotor blade (12) calculated by the rotor blade temperature detecting means; temperature difference calculating means for calculating a difference between the target temperature of the base temperature setting means and the temperature measured in fact at the base portion (13); and temperature control means (27) for controlling to heat or cool the base portion (13) in response to an output signal of the temperature difference calculating means.

The base portion (13) is heated to prevent a deposition of generated products. For this purpose, a target temperature of the base portion (13) is set on the basis of the temperature of the rotor blade (12) calculated by the rotor blade temperature detecting means in order to prevent an abnormal increase of the temperature of the rotor blade (12). A difference between that target temperature and the temperature measured in fact at the base portion (13) is calculated, and whether the base portion (13) is heated or cooled is controlled based on this difference. This enables a deposition of generated products to be prevented while attaining a protection of the rotor blade (12).

Further, according to the invention as set forth in claim a turbomolecular pump, which comprises baking means for heating for a predetermined time period and then cooling at least one of the turbomolecular pump P, a pipe (42) one end of which is connected to an inlet port (40) of the turbomolecular pump P, and an external device (46) connected to the other end of the pipe (42) while the turbomolecular pump P is operated without introducing gas, is characterized by comprising: baking temperature setting means for setting a target temperature (54) of a rotor blade (12) for heating; temperature difference calculating means (52) for calculating a difference between the target temperature (54) of the rotor blade (12) in the baking temperature setting means and the temperature of the rotor blade (12) obtained by the rotor blade temperature detecting means (1); heating means (29, 50) for heating for a predetermined time period at least one of an outer casing (136) and a base portion (13) of the turbomolecular pump P, the pipe (42), and the external device (46) in response to an output signal of the temperature difference calculating means (52); and cooling means (51) for cooling at least one of the outer casing (136), the base portion (13), the pipe (42), and the external device (46) after a predetermined time elapses since heating performed by the heating means (29, 50).

The baking temperature setting means sets a target temperature (54) for heating when baking is performed. A difference between the target temperature (54) and the temperature of the rotor blade (12) obtained by the rotor blade temperature detecting means is calculated. At least one of an outer casing (136) and a base portion (13) of the turbomolecular pump P, a pipe (42), and an external device (46) is heated for a predetermined time period. The heated outer casing or the like is then inversely cooled after a predetermined time elapses since the heating. Therefore, an utmost pressure can be increased within a chamber while attaining a protection of the rotor blade (12).

Further, according to another aspect of the invention, the pump is characterized by comprising lifetime prediction means (63) for predicting a lifetime of the rotor blade (12) and/or a deposition volume of generated products by combining plural items among how the temperature of the rotor blade (12) obtained by the rotor blade temperature detecting means exceeds a predefined allowable value, how long it exceeds the allowable value, and the pressure within a pipe (42) one end of which is connected to the inlet port (40) or within an external device (46) connected to the other end of the pipe (42), to be output as a signal value; and discriminating means (65) for performing an alarm display (67) when the signal value of the lifetime prediction means (63) is compared with a predefined set value and then exceeds the set value, and/or at least one of a variable setting of the target temperature of the base temperature setting means and a variable setting of the target temperature of the rotor blade (12) in the baking temperature setting means, based on a difference between the signal value and the set value.

The degree is measured how the temperature of the rotor blade (12) obtained by the rotor blade temperature detecting means, exceeds a predefined allowable value. Methods of measuring the degree include evaluation methods such as ranking and weighting. Then, the period during which it exceeds the allowable value is measured. The pressure within the pipe (42) or the external device (46) is then measured. The lifetime prediction means (63) predicts a lifetime of the rotor blade (12) and/or a deposition volume of generated products by combining plural items among these.

The prediction of a lifetime of the rotor blade (12) and/or a deposition volume of generated products may be individually or concurrently implemented. Alternatively, the alarm display (67) may be performed by comparing the output of the lifetime prediction means (63) with the predefined set value, or, otherwise, the target temperature of the base temperature setting means may be set variable or the target temperature of the baking temperature setting means may be set variable, according to the difference in the comparison result. The variable setting of the target temperature of the base temperature setting means and the variable setting of the target temperature of the baking temperature setting means may be individually or concurrently implemented. With the foregoing arrangement, an alarm can be provided at the proper timing of an overhaul for the rotor blade (12) or to prevent deterioration of the rotor blade (12) caused by heat generation.

Further, according to another aspect of the invention, a turbomolecular pump in which a rotor blade driving motor M is driven by a motor driver (8), is characterized in that the temperature of the rotor blade (12) obtained by the rotor blade temperature detecting means is compared with a predefined set temperature, to make an output of the motor driver (8) variable and/or to make an r.p.m. of the rotor blade (12) variable, based on the difference therebetween.

The rotor blade temperature detecting means is provided for always detecting a temperature of the rotor blade (12). The detected temperature of the rotor blade (12) is compared with a predefined set temperature to calculate a difference therebetween. Based on the difference, the output of the motor driver (8) is then adjusted, or the r.p.m. of the rotor blade (12) is adjusted. This allows the output of the motor driver (8) or the r.p.m. of the rotor blade (12) to be adjusted while maintaining a temperature of the rotor blade (12) within a restricted range, and can improve the exhaustion performance.

Further, according to another aspect of the invention, a turbomolecular pump in which a rotor blade driving motor M is driven by a motor driver (8) is, characterized by comprising: motor driver output set r.p.m. determining means (5) for comparing a temperature of the rotor blade (12) obtained by the rotor blade temperature detecting means with a predefined set temperature and, based on the difference therebetween, determining a driver output and/or a set r.p.m. which may be exerted to the maximum to the rotor blade driving motor M; and at least one of driver output switching means (6) for adjusting a driving output of the motor driver (8) in a variable manner or stopping the motor M in response to the output signal of the motor driver output set r.p.m. determining means (5), and r.p.m. compensating means (11) for comparing the set r.p.m. calculated by the motor driver output set r.p.m. determining means (5) with an output signal of an r.p.m. sensor (2) for detecting an r.p.m. of the rotor blade driving motor M, to drive the motor driver (8) based on the difference therebetween.

With such an arrangement, when a temperature of the rotor blade (12) is within an allowable value, the driving output of the motor driver (8) can be made variable by changing over the driver output switching means (6) in response to the signal of the motor driver output set r.p.m. determining means (5). The set r.p.m. of the rotor blade driving motor M can also be made variable. This allows the driving output and/or the set r.p.m. to be improved and the exhaustion performance (vacuum performance) of the turbomolecular pump P to be exerted to the maximum, thereby reducing losses.

If it is so modified in this way that the driving output of the motor driver (8) is increased and the set r.p.m. of the motor driver (8) is improved, the increased driving output or set r.p.m. (improved gas exhaustion performance) allows a variation in the r.p.m. of the rotor blade driving motor M pump to be lowered, and the exhaustion performance to be maintained even though the gas load is changed.

However, when a temperature of the rotor blade (12) exceeds an allowable value, the driver output switching means (6) permits the driving output of the motor driver (8) to be lowered or the brake, etc. to be applied in a worst case (although a variety of stopping techniques including shifting phases in current may be contemplated, any technique may be available). As an alternative, the r.p.m. compensating means (11) reduces the set r.p.m., thereby lowering a frequency of impinging the gas molecules on the rotor blade (12). The foregoing arrangement enables the temperature of the rotor blade to be reduced and deterioration of the rotor blade (12) caused by heat generation to be prevented. While either the driver output switching means (6) or the r.p.m. compensating means (11) may be employed, both of these means may be used in combination. The combined use of both means makes it possible to further improve precision of the exhaustion performance.

Further, another aspect of the invention is characterized in that a determination of the driver output and/or the set r.p.m. by the motor driver output set r.p.m. determining means (5) is adjusted by feeding back a detection signal detected by at least one sensor of an r.p.m. sensor (2) for detecting an r.p.m. of the rotor blade driving motor M, a motor current sensor (3) for detecting motor current of the rotor blade driving motor M, and an axial electromagnet current sensor (4) for detecting a current running toward an axial electromagnet that causes the rotor blade (12) to magnetically float.

Output signals of the r.p.m. sensor (2), the motor current sensor (3), and the axial electromagnet current sensor (4) vary correspondingly to a change in the gas load. It is therefore appropriate that an output signal of at least one of these sensors is fed back to adjust the driver and/or to adjust the set r.p.m. This enables a prompt adjustment of the driver output and/or adjustment of the set r.p.m., while keeping the temperature of the rotor blade (12) within the allowable value.

Further, another aspect of the invention is characterized in that a determination of the driver output and/or the set r.p.m. by the motor driver output set r.p.m. determining means (5) is carried out based on an external signal (15) predicting a change in a load flow rate from the external device (46) connected to the inlet port (40) of the turbomolecular pump P.

The arrangement in which the external signal is input makes it possible to set the driver output or the set r.p.m. of the motor driver (8) higher in advance, in response to the external signal from, from example, semiconductor manufacturing equipment, etc., before the gas load is increased. This allows the exhaustion performance to be maintained even with an abrupt increase of the gas load caused by releasing a gate valve (44) or the like.

Further, another aspect of invention is characterized by comprising rotor blade temperature discriminating means (73) for discriminating whether or not the temperature of the rotor blade (12) obtained by the rotor blade temperature detecting means exceeds a predefined allowable value; and cooling means (51) for cooling a surrounding area close to the rotor blade (12) or a surrounding area of the outer casing based on an output of the rotor blade temperature discriminating means (73).

A difference between the temperature of the rotor blade (12) obtained by the rotor blade temperature detecting means and a predefined allowable value is found, and then, based on the difference, a water-cooled tube or the like is used to cool around adjacent to the rotor blade (12) or around the outer casing. It can be therefore realized to further increase a gas flow rate and to improve a TMS temperature.

BRIEF DESCRIPTION OF THE DRAWINGS

FIG. 12 is a block diagram of the conventional turbomolecular pump.

BEST MODE FOR CARRYING OUT THE INVENTION

Hereinafter, embodiments of the present invention will be described with reference to the drawings.

Figure 1:
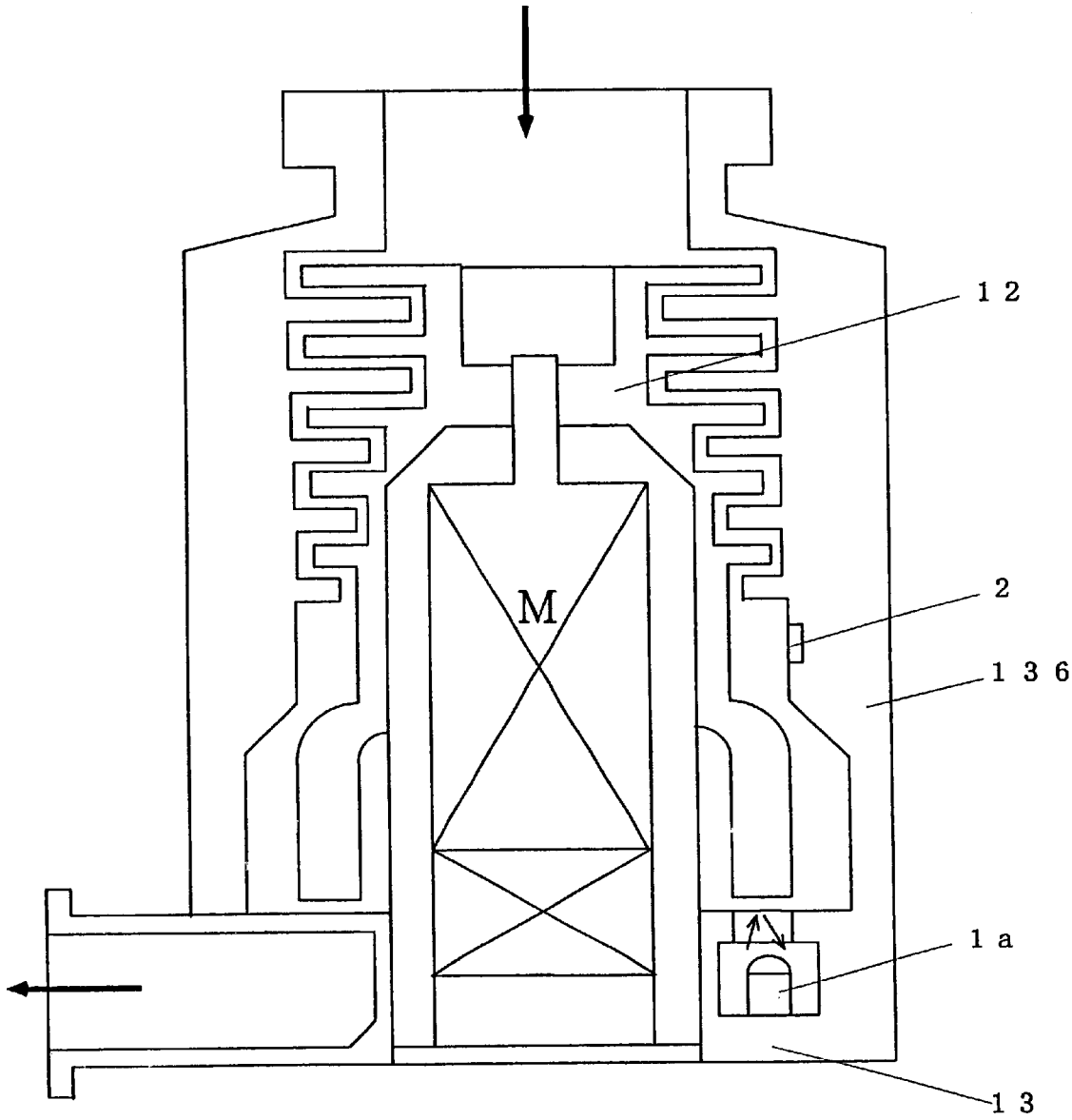
FIG. 1 is a schematic sectional view according to a first embodiment of the present invention.

FIG. 1 shows a schematic sectional view of a first embodiment of the present invention.

A turbomolecular pump P is a pump in which a certain momentum is imparted to a gas molecule impinging upon rotor blade 12 rotating at high speed and circumeferentially having blades divided into plural stages, to transport the gas. Rotor blade temperature sensor 1 is comprised of a radiation thermometer 1*a* facing toward e.g., the bottom of the rotor blade 12 which is disposed at a position of a base portion 13. The radiation thermometer 1*a* is adapted to indirectly detect a temperature of the rotor blade 12 using reflection heat energy produced by heat that radiates to the bottom of the rotor blade 12.

This turbomolecular pump P is equipped with an r.p.m. sensor 2 for detecting an r.p.m. of the turbomolecular pump P, a motor current sensor 3 for detecting a current of a motor M in the turbomolecular pump P, and an axial electromagnet current sensor 4 for detecting a current of an axial electromagnet in the turbomolecular pump P, in addition to the above-mentioned rotor blade temperature sensor 1 for detecting a temperature of the rotor blade in the turbomolecular pump P.

Figure 2:
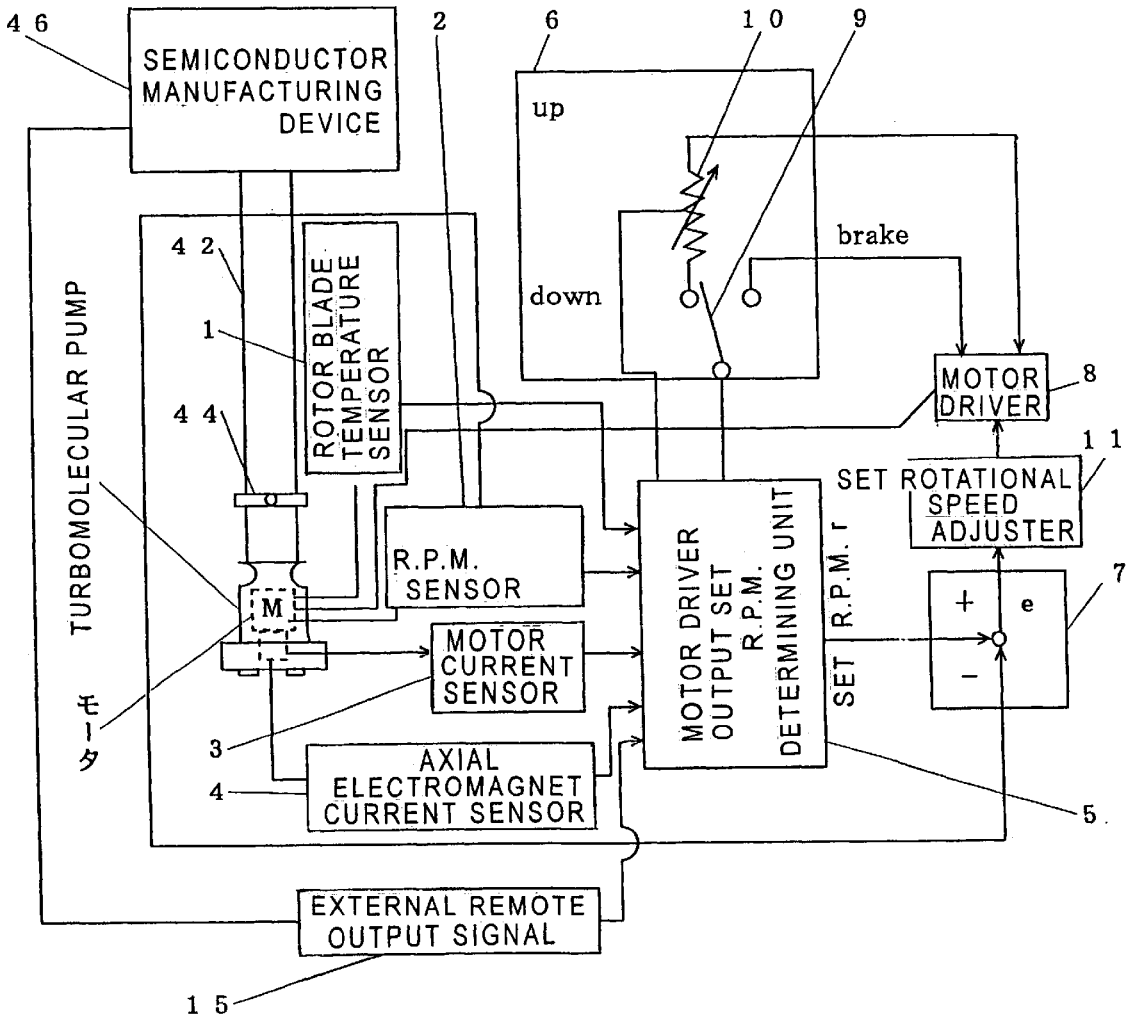
FIG. 2 is a block diagram according to the first embodiment of the present invention.

FIG. 2 is a block diagram of the first embodiment of the present invention. A motor driver output set r.p.m. determining unit 5 is adapted to be supplied with the temperature of the rotor blade in the turbomolecular pump P which is detected by the rotor blade temperature sensor 1, the r.p.m. of the turbomolecular pump P which is detected by the r.p.m. sensor 2, the motor current that is detected by the motor current sensor 3, and the current of the axial electromagnet which is detected by the axial electromagnet current sensor 4.

The motor driver output set r.p.m. determining unit 5 is also supplied with an external remote output signal 15 from a piece of semiconductor manufacturing equipment.

The motor driver output set r.p.m. determining unit 5 is a circuit used to compare a measurement value with a preset set value based on the respective signals of the sensors 1, 2, 3, and 4, and the external remote output signal 15, to determine a driving output which can be exerted to the maximum and a set r.p.m. This unit corresponds to the claimed motor driver output set r.p.m. determining means. A driver output switching unit 6, an r.p.m. comparator 7, and a set r.p.m. adjuster 11 are connected at an output side of the motor driver output set r.p.m. determining unit 5.

The driver output switching unit 6 is constituted by: a changeover switch 9 for changing over under a determination of the motor driver output set r.p.m. determining unit 5 between a variable adjustment of the driver output and an emergency stop (brake) when an abnormal increase in the temperature of the rotor blade 12 is detected; and a driver output adjuster 10 for adjusting the driver output in a variable manner based on an output of the motor driver output set r.p.m. determining unit 5. This corresponds to the claimed driver output switching means. The set r.p.m. adjuster 11 is intended to adjust an r.p.m. based on a difference between the set r.p.m. computed by the motor driver output set r.p.m. determining unit 5 and the r.p.m. detected by the r.p.m. sensor 2. This corresponds to the claimed r.p.m. compensating means.

A description will now be made of an operation of a turbomolecular pump in accordance with the first embodiment of the present invention.

The rotor blade temperature sensor 1 is placed, e.g., within the base potion 13, in which heat radiates toward the bottom of the rotor blade 12. The reflection heat energy produced thereby is then measured to indirectly detect a temperature of the rotor blade 12. Provision thereof within the base portion 13 achieves an accommodation in a small space without affecting the performance of the turbomolecular pump. Alteratively, the temperature sensor itself may also be inserted, for example, into the rotor blade 12 so as to directly detect a temperature of the rotor blade 12.

The detected temperature of the rotor blade 12 is input to the motor driver output set r.p.m. determining unit 5, and then compared with a preset temperature value to calculate a difference therebetween. If the difference is within a predetermined temperature range, the changeover switch 9 is then connected to the driver output adjuster 10 side, an output is adjusted by the driver output adjuster 10 according to the difference, and the result is sent to a motor driver 8. On the other hand, if the difference is beyond the predetermined temperature range (i.e., when an abnormal increase occurs in the temperature of the rotor blade 12), the changeover switch 9 is then connected to the brake side, and a stop signal is sent to the motor driver 8, to stop the motor M.

Besides the foregoing adjustment of the driver output, the temperature of the rotor blade 12 can also be controlled by adjusting the r.p.m. of the motor M. More specifically, a set r.p.m. of the motor M is computed based on the above-noted difference in temperatures obtained by the motor driver output set r.p.m. determining unit 5, to calculate a difference between the set r.p.m. and the r.p.m. detected by the r.p.m. sensor 2. The set r.p.m. adjuster 11 compensates for an r.p.m. depending upon the difference, and the result is sent to the motor driver 8.

The adjustment of the driver output and the adjustment of the r.p.m. may be performed by individual controls or by a combined control. Such a combined control can further improve the exhaustion performance of the turbomolecular pump.

Further, the r.p.m. of the turbomolecular pump P which is detected by the r.p.m. sensor 2, the motor current detected by the motor current sensor 3, and the current of the axial electromagnet which is detected by the axial electromagnet current sensor 4 accompany changes in accordance with load flow rates, respectively. Therefore, in order to attain stability in the exhaustion performance, and an increase in an allowable flow rate and pressure under a condition within an allowable temperature range of the rotor blade 12, the respective sensor outputs are fed back to the motor driver output set r.p.m. determining unit 5. A signal used for the feedback may be of any of the r.p.m. sensor 2, the motor current sensor 3 and the axial electromagnet current sensor 4 which have been inputted to the motor driver output set r.p.m. determining unit 5. This allows the load flow rate to be controlled in a stable manner to the allowable full extent while maintaining the allowable temperature of the rotor blade 12.

More specifically, consider that, for example, under a condition within the allowable temperature of the rotor blade 12, the r.p.m. of 35,000 of the turbomolecular pump P is lowered by 1,000 rpm or more (to 34,000 rpm or less). It is judged that a decrease of the load flow rate accompanied with the reduced r.p.m. requires an increase of the driver output in the motor driver output set r.p.m. determining unit 5. During this, the changeover switch 9 in the driver output switching unit 6 is connected to the driver output adjuster 10 side, where the driver output adjuster 10 increases the turbomolecular pump driving output so that the exhaustion performance can be exerted to the full extent. This can improve the exhaustion performance of the turbomolecular pump so as to be exerted to the maximum while reducing a loss. In addition, fluctuation in the r.p.m. relative to a change in the gas load can be lowered.

Similarly, consider that, for example, under a condition within the allowable temperature of the rotor blade 12, the r.p.m. of 35,000 rpm of the turbomolecular pump P is lowered by 1,000 rpm or more from (to 34,000 rpm or less) while the motor current is in a saturated state (a torque of the turbomolecular pump P is insufficient). During this, it is also judged that an increase of the driver output is required in the motor driver output set r.p.m. determining unit 5. That is, a variable adjustment of the driver output adjuster 10 allows the turbomolecular pump driving output to be increased. As a result, the exhaustion performance of the turbomolecular pump can be improved to the full extent.

Further, consider as an additional example that there is an externally attached external device 46 such as a piece of semiconductor manufacturing equipment, and that there is an external remote output signal 15 (a signal for releasing a gate valve 44) leading to this external device 46. During this, the driver output adjuster 10 is variably adjusted in time with a release of a gate valve 44, and the turbomolecular pump driving output increased is in advance, or alternatively a set r.p.m. is increased in advance by the set r.p.m. adjuster 11. This allows the turbomolecular pump driving output of the motor drive 8 to be improved in advance before the gas load is increased, to improve the exhaustion performance of the turbomolecular pump P, to lower a variation in the r.p.m. relative to an abrupt change in the gas load, and to maintain the exhaustion performance.

In this way, in the case where the rotor blade temperature is within the set value, in response to the signal of the motor driver output set r.p.m. determininig unit 5, the driver output adjuster 10 increases the turbomolecular pump driving output of the motor driver 8, or alternatively the set r.p.m. adjuster 11 increases the turbomolecular pump set r.p.m. of the motor driver. This allows the turbomolecular pump driving output and the turbomolecular pump set r.p.m. to be improved, to exert the exhaustion performance of the turbomolecular pump to the maximum, while fluctuation in the r.p.m. relative to a change in the gas load can also be lowered.

A second embodiment of the present invention will now be described with reference to the drawings.

Figure 3:
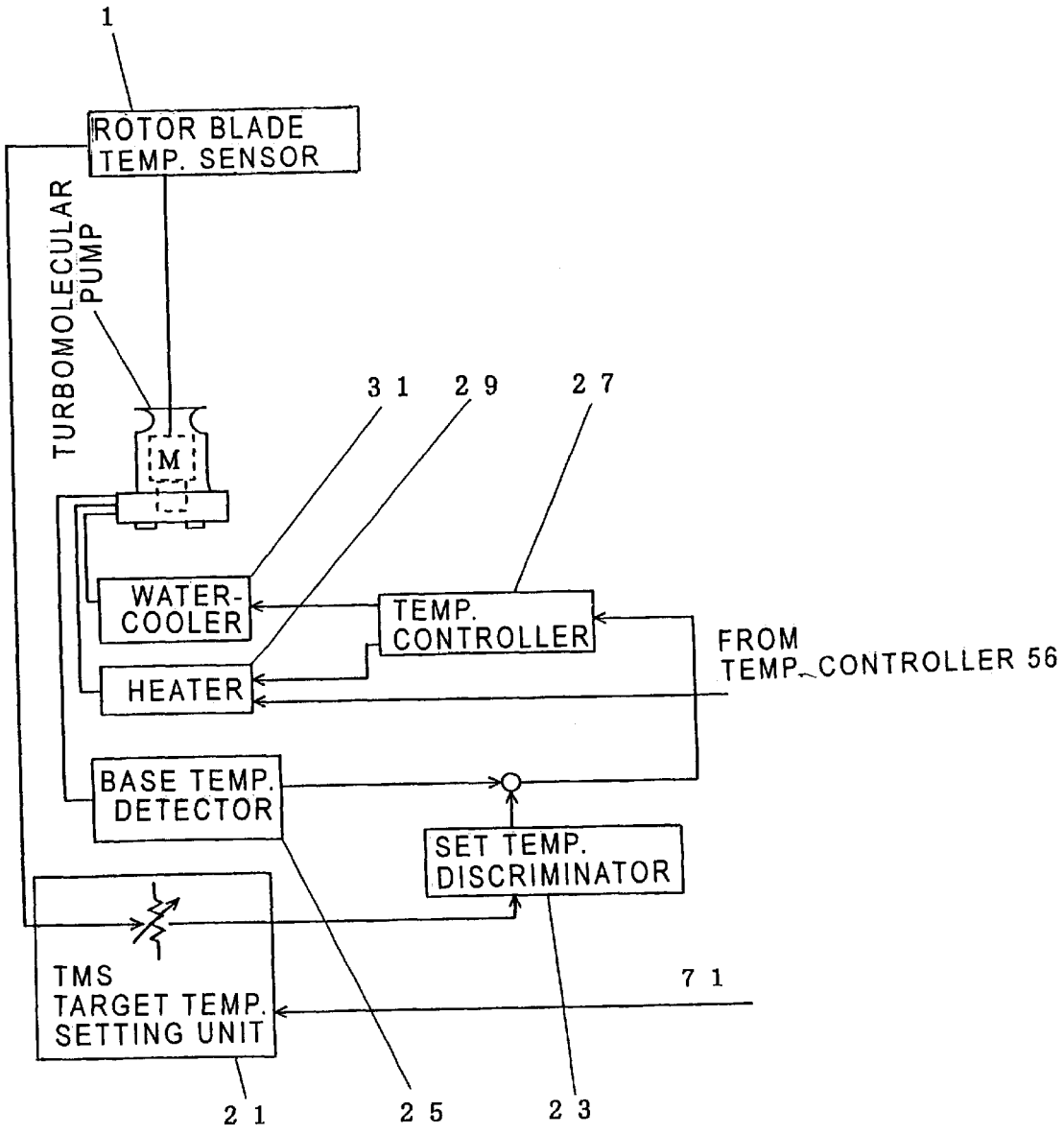
FIG. 3 is a block diagram according to a second embodiment of the present invention.

It will be noted that the identical elements with those in FIGS. 1 and 2 are designated by the identical numerals for omitting an explanation. FIG. 3 shows a block diagram of a second embodiment of the present invention. A TMS target temperature setting unit 21 is adapted to set a temperature of a base portion 11 which can be elevated in response to an output signal of a rotor blade temperature sensor 1. A set temperature discriminator 23 is adapted to compensate for a temperature in response to an output signal of the TMS target temperature setting unit 21 based on each environmental variable of the turbomolecular pump.

The TMS target temperature setting unit 21 and the set temperature discriminator 23 correspond to the claimed base temperature setting means. A base temperature detector 25 is adapted to detect a temperature of the base portion 13. A temperature controller 27 is intended to determine, based on a difference between an output signal of the set temperature discriminator 23 and an output signal of the base temperature detector 25, whether the base portion 13 is to be heated or to be cooled, to output a heating or cooling control signals. This corresponds to the claimed temperature control means. A heater 29 is intended to heat the base portion 13 in response to a heating control signal from the temperature controller 27. On the other hand, a water-cooler 31 is intended to cool the base portion 13 in response to a cooling control signal from the temperature controller 27.

A description will now be made of an operation of a turbomolecular pump in accordance with the second embodiment of the present invention. The second embodiment of the present invention attempts at a control for TMS. In FIG. 3, the TMS target temperature setting unit 21 sets a temperature of the base portion 13 in response to the output signal of the rotor blade temperature sensor 1. The output of the TMS target temperature setting unit 21 is compensated for temperature through the set temperature discriminator 23. The output of the set temperature discriminator 23 is compared with the temperature of the base portion 13 which is detected by the base temperature detector 25, to calculate a difference therebetween.

The difference is input to the temperature controller 27, to determine whether the base portion 13 is to be heated or to be cooled. Then, in response to a heating control signal from the temperature controller 27, the heater 29 heats the base portion 13. Otherwise, in response to a cooling control signal from the temperature controller 27, the water-cooler 31 cools the base portion 13. During these operations, TMS always monitors the temperature of the rotor blade. As a result, it can be realized to prevent a breakage caused by an abnormal increase in the temperature of the rotor blade, while preventing deposition.

A third embodiment of the present invention will now be described with reference to the drawings.

Figure 4:
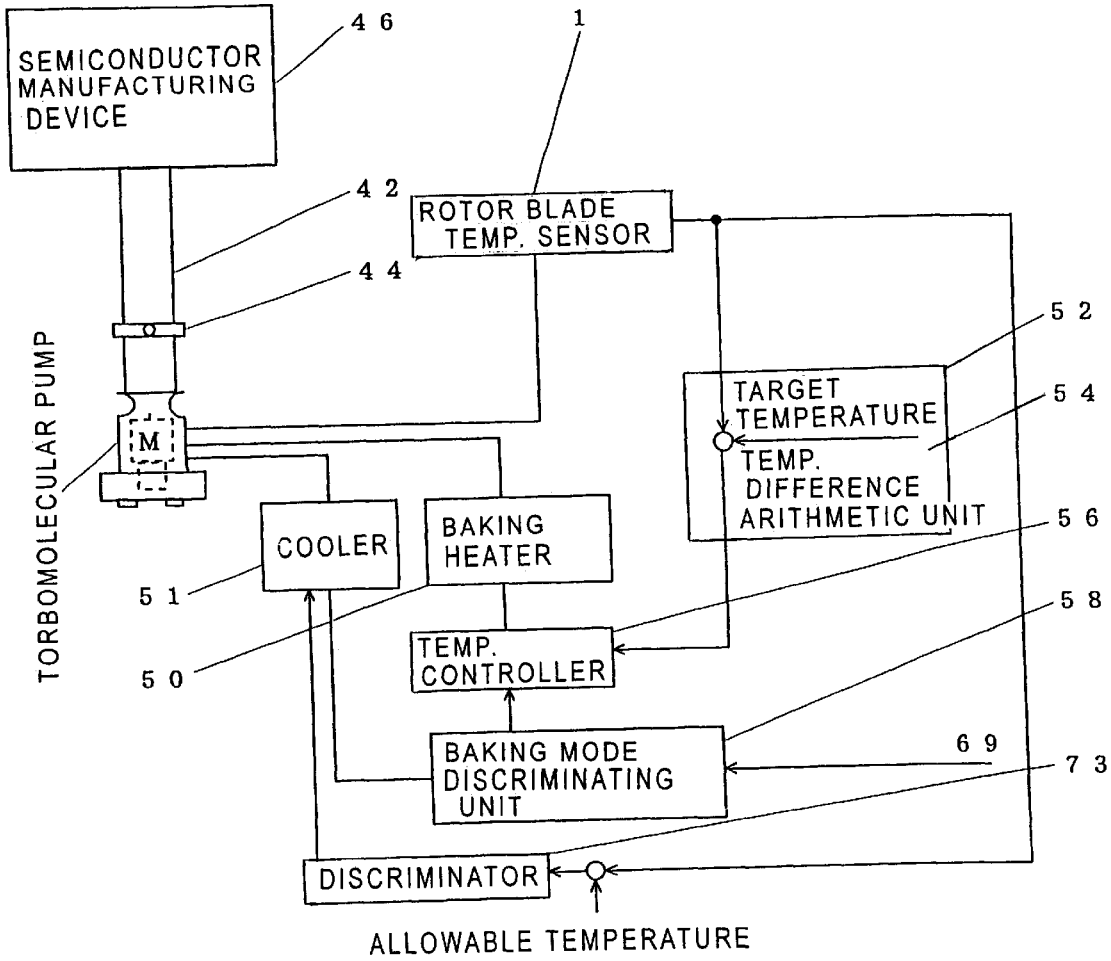
FIG. 4 is a block diagram according to a third embodiment and a fifth embodiment of the present invention.

It will be noted that the identical elements with those in FIGS. 1 and 2 are designated by the identical numerals for omitting an explanation. FIG. 4 shows a block diagram of a third embodiment of the present invention. A turbomolecular pump P has an inlet port 40 connected to a pipe 42. A gate valve 44 is provided at the midway of the pipe 42 so that an introduction of gas can be blocked. An external device 46 is connected to the other end of the pipe 42. A baking heater 50 and a cooler 51 are disposed at an outer casing 136 and the base portion 13 of the turbomolecular pump P, on a circumferential surface of the pipe 42, and on the wall surface of the external device 46.

A temperature difference arithmetic unit 52 is intended to calculate a difference between a target temperature 54 that is set for heating performed by the baking heater 50 and an output signal of the rotor blade temperature sensor 1. This corresponds to the claimed temperature difference calculation means. A temperature controller 56 is adapted to send a heating control signal to the baking heater 50 or, alternatively, to the the heater 29 in the base portion 13 depending upon the difference calculated by the temperature difference arithmetic unit 52. The baking heater 50 is made up of, e.g., a heater, and the cooler 51 is made up of, e.g., a water-cooled tube. A baking mode discriminating unit 58 is adapted to instruct an implementation for baking or to manage a time period for heating or a time period for cooling thereafter.

A description will now be made of an operation of a turbomolecular pump in accordance with the third embodiment of the present invention. The third embodiment of the present invention attempts at a control for baking. In FIG. 4, the baking mode discriminating unit 58 determines an initiation of baking. The gate valve 44 is closed in response to this instruction to initiate baking. In the state where the gate valve 44 is closed, to begin with, heat is applied to the outer casing 136 and the base portion 13 of the turbomolecular pump P, a circumferential surface of the pipe 42, and the wall surface of the external device 46.

Heating permits gas molecules absorbed on the wall surfaces of the device and pipeline and on the surface inside the turbomolecular pump to be resolved, and helps degassing by transmission. The higher the heating temperature is, the more expectable this effect of degassing is. When an initiation instruction is issued from the baking mode discriminating unit 58, a difference between the output signal of the rotor blade temperature sensor 1 and the target temperature 54 is then calculated. Based on the difference, the temperature controller 56 sends a heating control signal to the baking heater 50 or the heater 29 in the base portion 13. The heating control signal may be a continuous signal or an ON/OFF signal. The continuous signal will also make it possible to perform a variable adjustment.

In response to this heating control signal, heat is performed by the baking heater 50 or the heater 29 in the base portion 13 for a time period preset by the baking mode discriminating unit 58. Thereafter, the baking mode discriminating unit 58 issues a cooling instruction. In this case, a natural cooling is too time-consuming, and cooling is forcibly performed by the cooler 51. The cooler 51 has, for example, the water-cooled tube disposed adjacent to the rotor blade 12. This cooling is also carried out for a time period preset by the baking mode discriminating unit 58. As described above, since baking is carried out while the temperature of the rotor blade is monitored, a breakage caused by an abnormal increase in the temperature of the rotor blade can be prevented while baking exercises the degassing effect to the maximum extent.

A fourth embodiment of the present invention will now be described with reference to the drawings.

Figure 5:
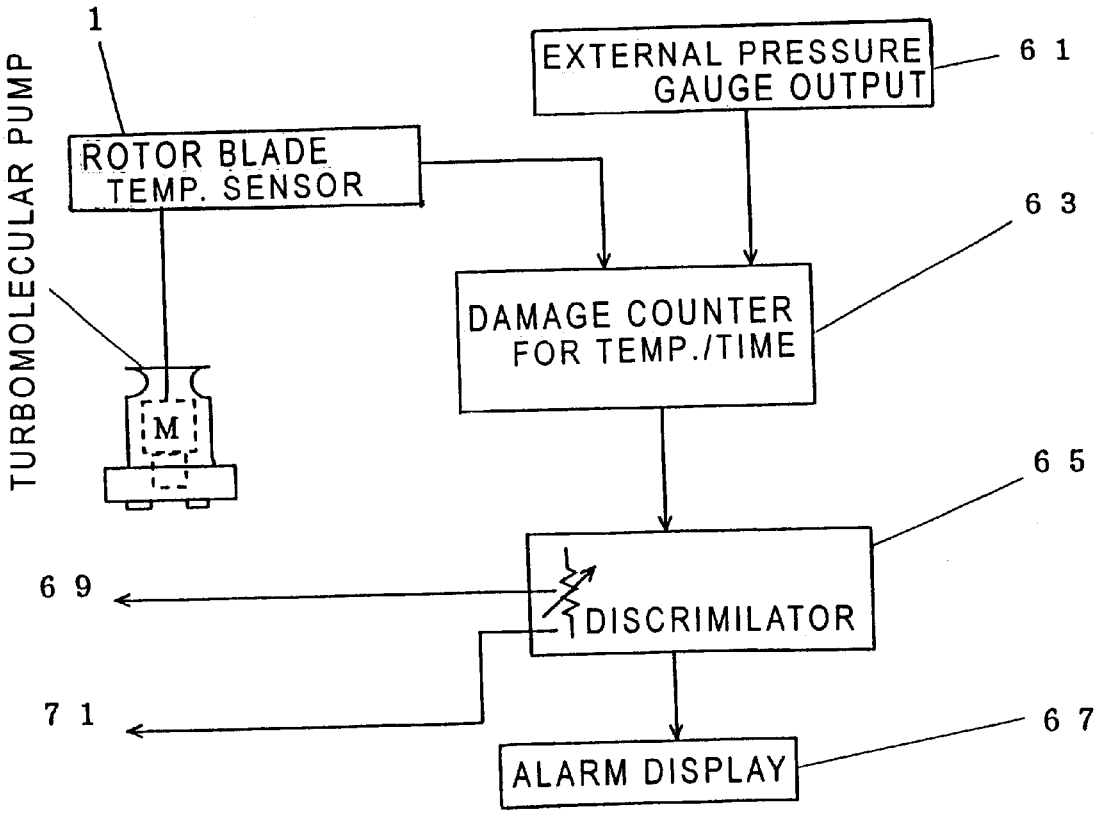
FIG. 5 is a block diagram according to a fourth embodiment of the present invention.

It will be noted that the identical elements with those in FIGS. 1 and 2 are designated by the identical numerals for omitting an explanation. FIG. 5 shows a block diagram of a fourth embodiment of the present invention. An external pressure gauge output 61 is intended to output a pressure value within a pipe 42 and the like from a pressure gauge disposed at the pipe 42 and an external device 46, etc.

A damage counter for temperature/time 63, which is inputted with an output of rotor blade temperature sensor 1 and an output of the external pressure gauge output 61, is intended to predict a lifetime of the rotor blade or a deposition volume of generated products by computation based on these signals for outputting as a signal value. This corresponds to lifetime prediction means. A discriminator 65 is intended to find a difference between an output signal from the damage counter for temperature/time 63 and a predefined set value for an alarm display at the set value or larger. This corresponds to discriminating means.

A description will now be made of an operation of a turbomolecular pump in accordance with the fourth embodiment of the present invention. The fourth embodiment of the present invention involves a protection ability of the turbomolecular pump P. In FIG. 5, a pressure value is inputted to the damage counter for temperature/time 63 from a pressure gauge disposed at a pipe 42 and an external device 46, etc. On the other hand, a temperature of the rotor blade is inputted from the rotor blade temperature sensor 1. The damage counter for temperature/time 63 performs a lifetime prediction for the rotor blade based on the temperature of the rotor blade and the time during which the temperature at issue continues. The strength of the rotor blade depends upon materials used for the rotor blade, because it is lowered depending upon the temperature of the rotor blade and the time during which the temperature at issue continues.

A technique for a lifetime prediction is performed in such a manner that, e.g., weighting is carried out by converting stepwise the temperature of the rotor blade into numerical values, and then multiplying these numerical values by time to obtain a lifetime value. However, lifetime prediction techniques are not limited thereto, and include all the techniques by which the temperature of the rotor blade is associated with the time. This lifetime value is sent to the discriminator 65, and is then compared in magnitudes with a preset set value. When the lifetime value exceeds the set value, an alarm display 67 is issued. The alarm display 67 allows one to know timing of an overhaul. Further, if the set value is plural, the alarm display 67 can be issued step by step.

In this regard, while the discriminator 65 compares in magnitudes the lifetime value with the set value, it can also calculate a difference therebetween. Based on the calculation result of the difference, an instruction signal 69 can be issued instructing to lower the temperature of the rotor blade 12 when baking is performed. Similarly, an instruction signal 71 can be issued instructing to lower the temperature of the rotor blade 12 when TMS is controlled. This results in an ability not only to merely alarm but also to restrict an operation of the turbomolecular pump to an operation according to the damage when the overhaul is soon.

A fifth embodiment of the present invention will now be described with reference to the drawings.

It will be noted that the identical elements with those in FIGS. 1 and 2 are designated by the identical numerals for omitting an explanation. FIG. 4 shows a block diagram of a fifth embodiment of the present invention. A discriminator 73 is intended to compare a temperature signal from rotor blade temperature sensor 1 with a preset allowable temperature. This corresponds to rotor blade temperature discriminating means.

A description will now be made of an operation of a turbomolecular pump in accordance with the fifth embodiment of the present invention. The fifth embodiment of the present invention involves an additional improvement in the performance of the turbomolecular pump P. In FIG. 4, a discriminator 73 compares a temperature signal from a rotor blade temperature sensor 1 with a preset allowable temperature. As a result, when the temperature signal from the rotor blade temperature sensor 1 exceeds the allowable temperature, cooling is forcibly performed by a cooler 51. The cooler 51 has, for example, a water-cooled tube disposed adjacent to the rotor blade 12, but the tube may be disposed at an outer casing 136 of the turbomolecular pump P. As described above, cooling is forcibly performed when the signal exceeds the allowable temperature of the rotor blade. This enables a gas flow rate to be more preserved and a base target temperature to be more improved when TMS is controlled.

Figure 6:
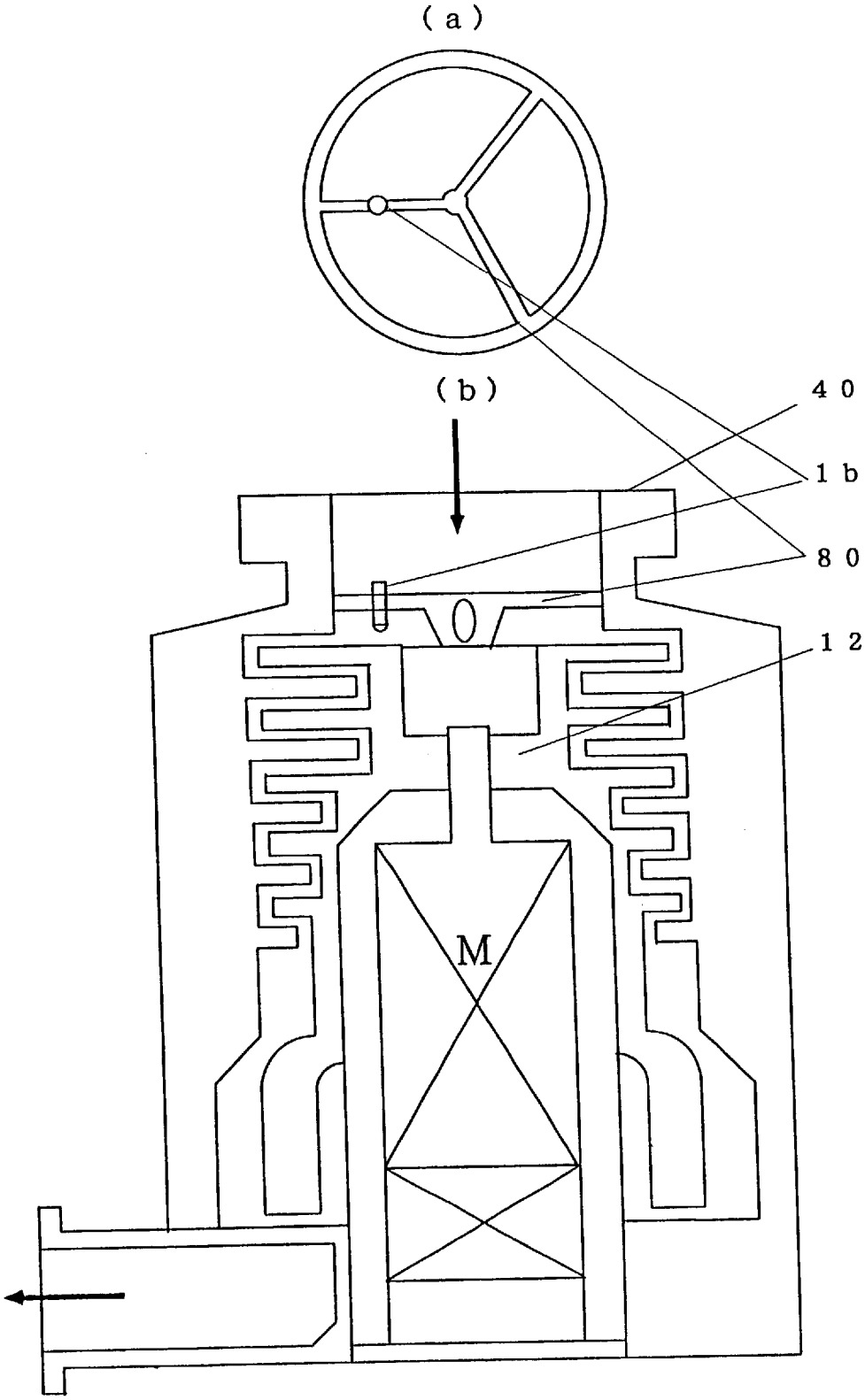
FIG. 6 is an illustration of another embodiment mode for detecting a temperature of a rotor blade.

Incidentally, as illustrated in FIG. 6, the rotor blade temperature sensor 1 according to the present invention may be so arranged that a radiation thermometer 1*b* is disposed at a flange of an inlet port 40. The radiation thermometer 1*b* faces to the top of the rotor blade 12, and is supported by a thermometer fixing plate 80. The radiation thermometer 1*b* detects a temperature of the rotor blade 12 using reflection heat energy produced by heat that radiates to the top surface of the rotor blade 12.

A sixth embodiment of the present invention will now be described with reference to the drawings.

Figure 7:
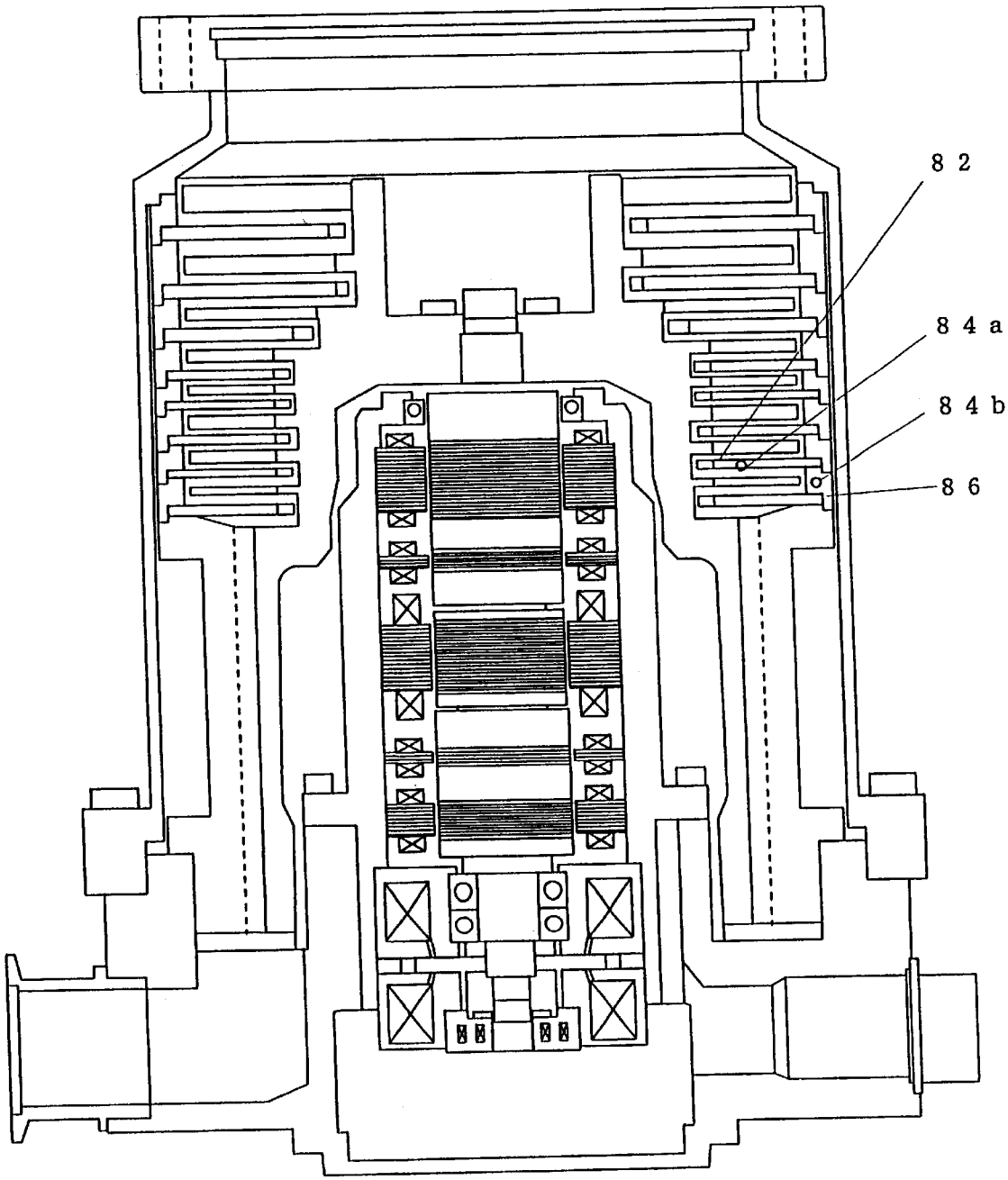
FIG. 7 is an illustration of another embodiment mode (a sixth embodiment of the present invention) for detecting a temperature of a rotor blade.

The sixth embodiment of the present invention represents another embodiment mode for detecting a temperature of a rotor blade. As shown in FIG. 7, a temperature detecting element 84*a* or 84*b* is adapted to be embedded into part of a stator blades, or fixed blades, also referred to herein as fixing blade 82 or part of a fixing blade spacer 86. The temperature detecting element 84*a* or 84*b* has a temperature set in a state lower by a predetermined temperature than the rotor blade 12 due to radiant heat and the like. This predetermined temperature is experimentally measured in advance, or computed based on coefficient of thermal conductivity or emissivity, using gas as medium, so that the temperature of the rotor blade 12 can be estimated.

Figure 8:
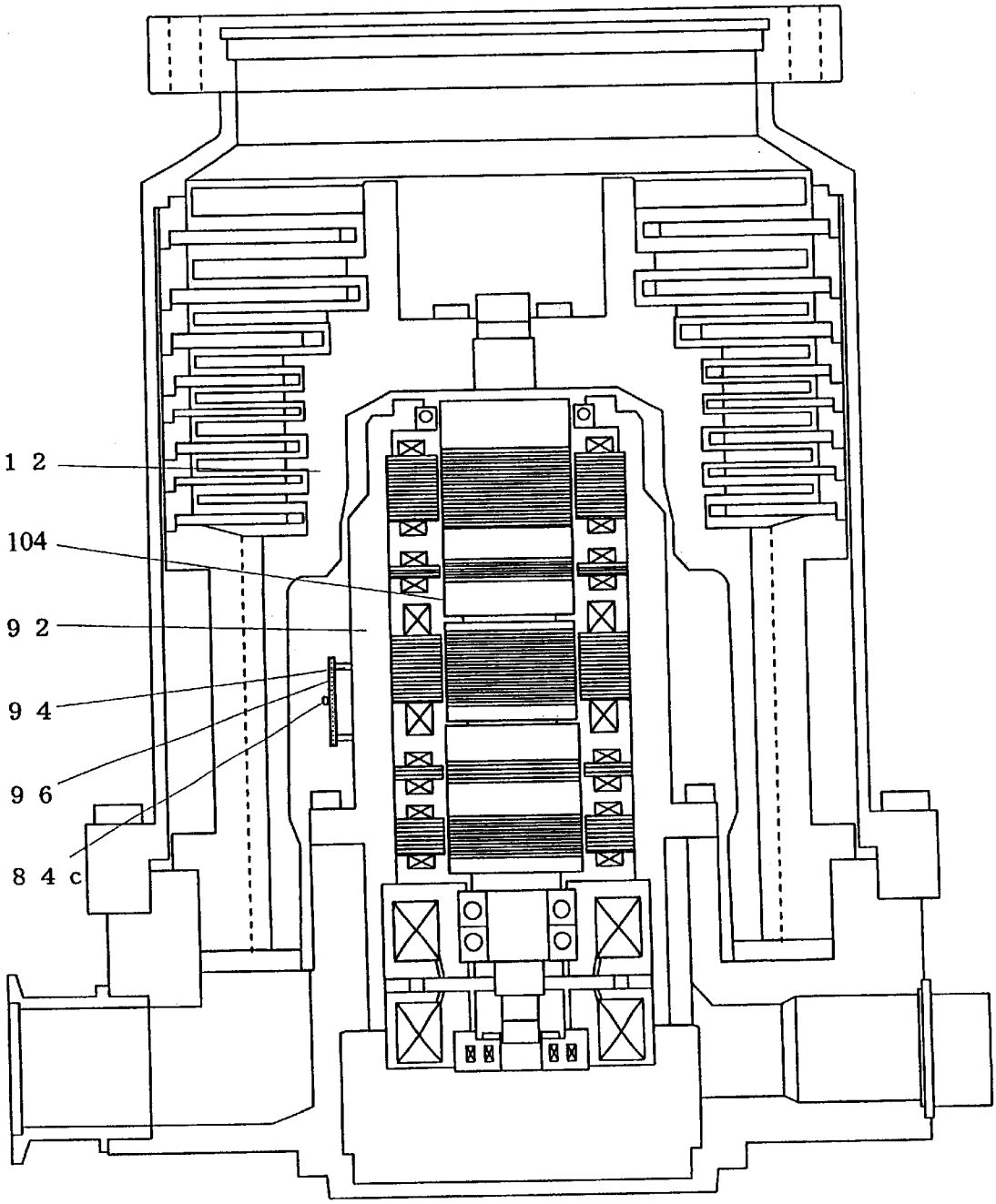
FIG. 8 is an illustration of another embodiment mode for detecting a temperature of a rotor blade.

FIG. 8 further depicts a state where a temperature detecting element 84*c* is disposed at another place. A flat plate 96 is fixed in parallel with the rotor blade 12 to a curved surface of a stator 92, which forces the rotor blade 12, through a supporting portion 94 made of a thermally insulating material. The temperature detecting element 84*c* is adhered to this flat plate 96. An arithmetic unit calculates a difference between a temperature of the flat plate 96 measured by the temperature detecting element 84*c* and a temperature of the stator 92 measured by another temperature detecting element (not shown), and then experimentally or theoretically estimates a difference in temperatures between the rotor blade 12 and the flat plate 96. The temperature of the rotor blade 12 can be therefore obtained. The theoretical estimation can be proportionally found based on a temperature gradient from the rotor blade 12 to the stator 92.

A seventh embodiment of the present invention will now be described with reference to the drawings.

Figure 9:
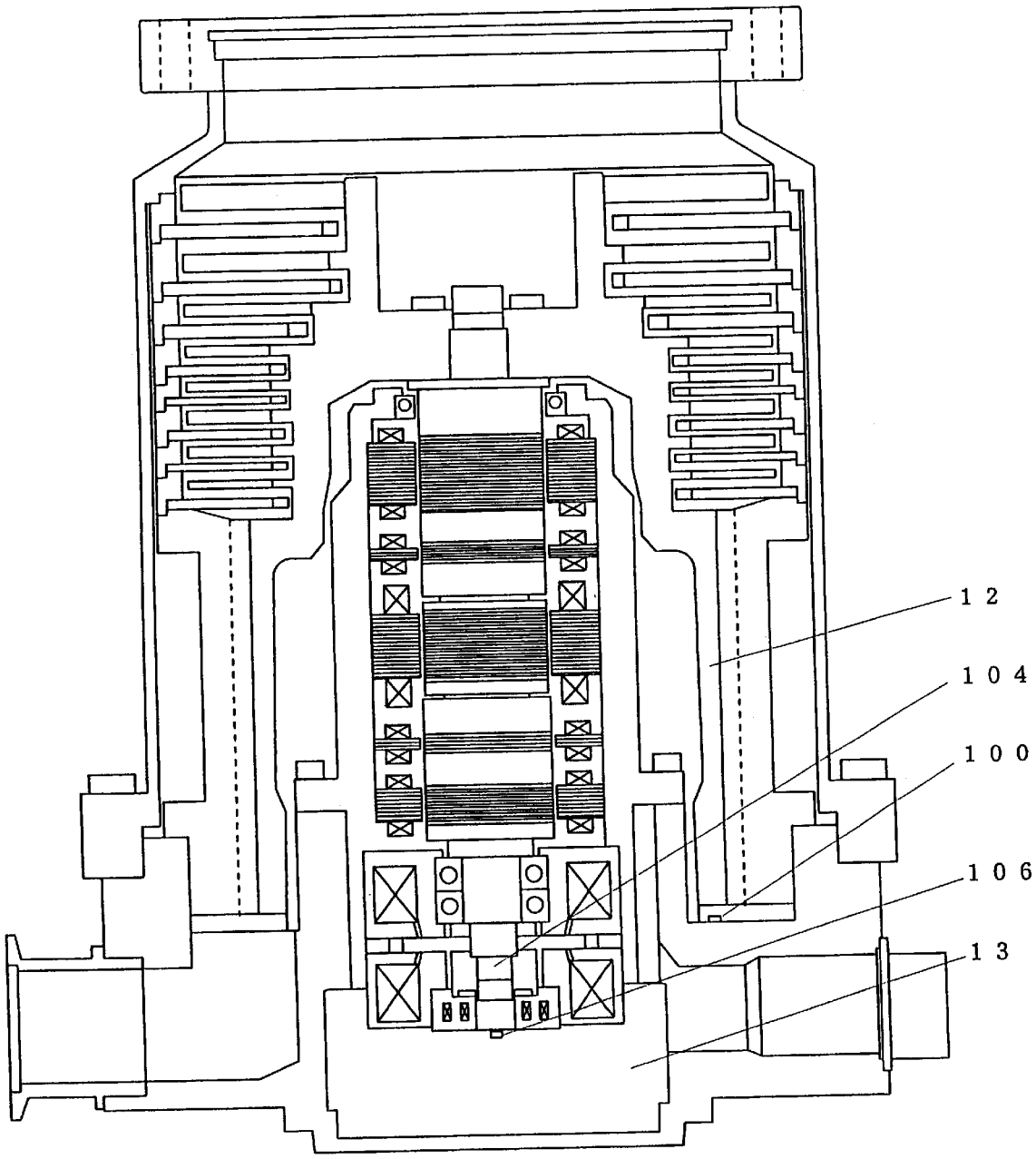
FIG. 9 is an illustration of another embodiment mode (a seventh embodiment of the present invention) for detecting a temperature of a rotor blade.

The seventh embodiment of the present invention represents still another embodiment mode for detecting a temperature of a rotor blade. As shown in FIG. 9, a position sensor 100 is disposed at the base portion 13, confronting the bottom of the rotor blade 12. A first arithmetic unit (not shown) is adapted to calculate a variation in distances measured by the position sensor 100 before and after thermal expansion. The position sensor 100 and the corresponding first arithmetic unit correspond to first length measuring means.

A position sensor 106 is disposed at the base portion 13, confronting the bottom of a main shaft 104 of the rotor blade 12. A second arithmetic unit (not shown) is adapted to calculate a variation in distances measured by the position sensor 106 before and after thermal expansion. The position sensor 106 and the second arithmetic unit correspond to second length measuring means. A third arithmetic unit is intended to arithmetically estimate a temperature of the rotor blade 12 based on a difference between an output of the first arithmetic unit and an output of the second arithmetic unit. This corresponds to calculation means.

A description will now be made of an operation of a turbomolecular pump in accordance with the seventh embodiment of the present invention. In FIG. 9, the position sensor 100 measures a distance between the bottom of the rotor blade 12 subjected to magnetically floating and the position sensor 100. The first arithmetic unit calculates a variation in distances taken before and after thermal expansion for the rotor blade 12 under different temperatures, in response to the output signal of the position sensor 100. The position sensor 106 measures a distance between the bottom of the main shaft 104 of the rotor blade 12 and the position sensor 106. Under the same temperature condition as that obtained by the position sensor 100, a second arithmetic unit calculates a variation in distances measured before and after thermal expansion for the main shaft 104 of the rotor blade 12 under different temperatures, in response to the output signal of the position sensor 106.

Thereafter, the third arithmetic unit calculates a difference between an output of the first arithmetic unit 102 and an output of the second arithmetic unit. After calculating that difference, the third arithmetic unit estimates by computation the temperature of the rotor blade 12 based on the calculation result, considering coefficients of thermal expansion and the like different in materials of the rotor blade 12 and the main shaft 104 of the rotor blade 12 (the rotor blade 12 and the main shaft 104 of the rotor blade 12 are in general made of different materials and thus have different coefficients of thermal expansion, which can be treated as a fixed constant. Therefore, there is no problem in calculation). This allows the temperature of the rotor blade to be measured without affecting a flow of gas.

An eighth embodiment of the present invention will now be described with reference to the drawings.

Figure 10:
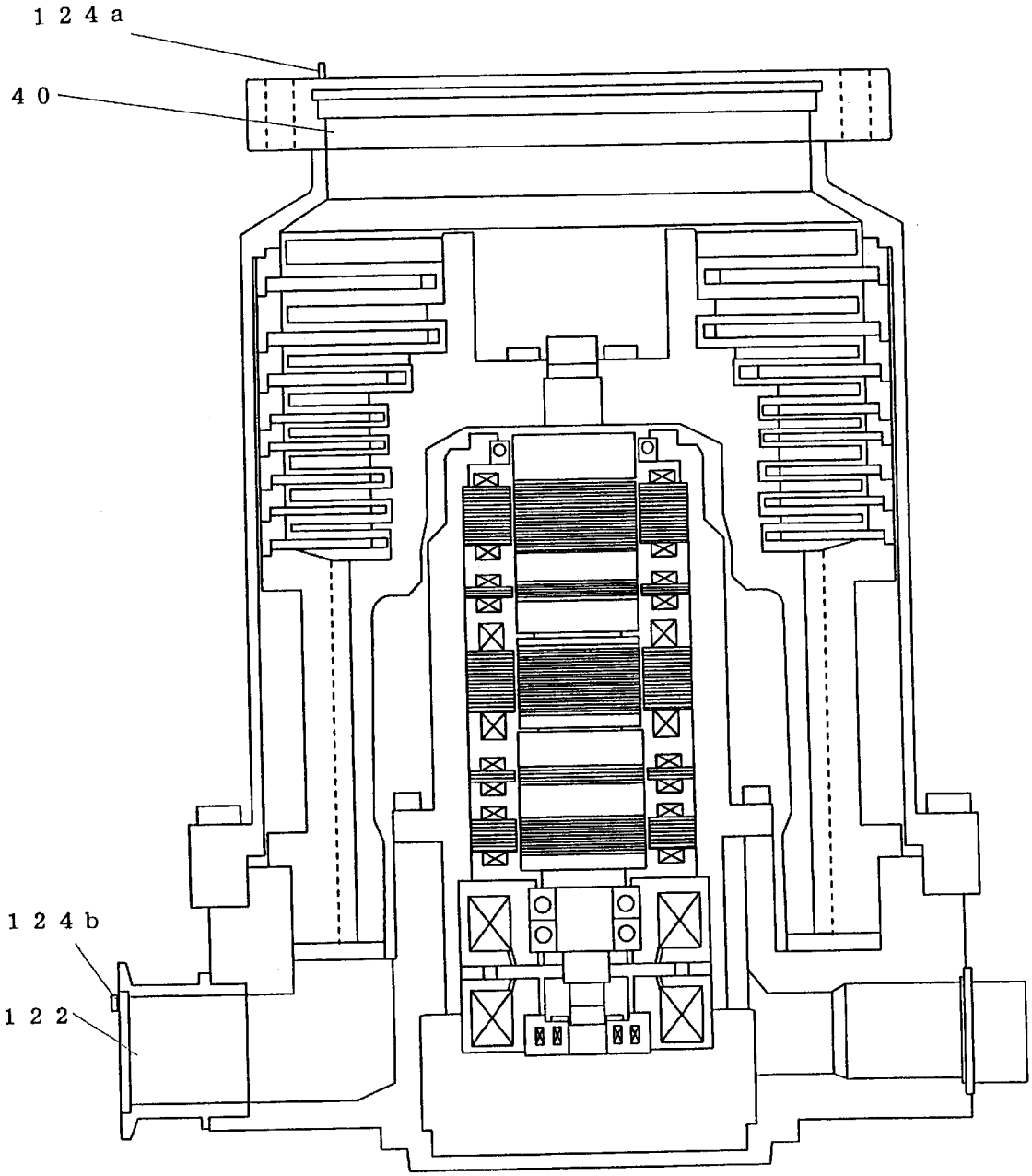
FIG. 10 is an illustration of another embodiment mode (an eighth embodiment of the present invention) for detecting a temperature of a rotor blade.

The eighth embodiment of the present invention represents still another embodiment mode for detecting a temperature of a rotor blade. As shown in FIG. 10, thermometers 124*a* and 124*b* are disposed at an inlet port 40 and an exhaust port 122, respectively. An arithmetic unit (not shown) is adapted to calculate a difference between a temperature measured by the thermometer 124*a* and by the thermometer 124*b*, to estimate by computation a temperature of a rotor blade 12 based on the temperature difference.

Figure 11:
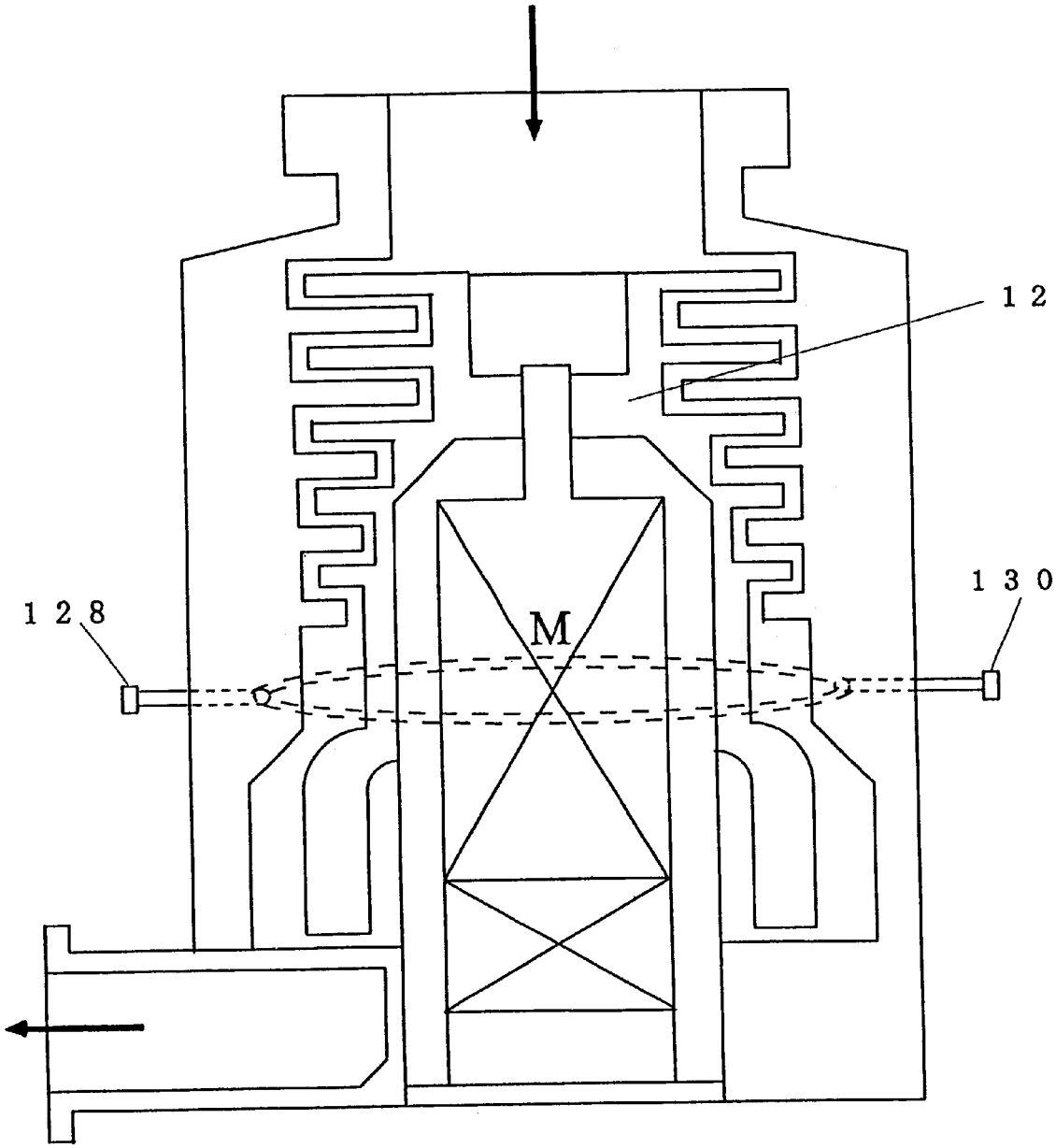
FIG. 11 is an illustration showing another embodiment mode for detecting a temperature of a rotor blade.

Further, as shown in FIG. 11, first and second thermometers (which are not shown) are, respectively, disposed at an entry 128 and an exit 130 of a water-cooled tube provided for water-cooling the rotor blade 12. An arithmetic unit (not shown) is adapted to calculate a difference between a temperature measured by the first thermometer and by the second thermometer to estimate by computation a temperature of the rotor blade 12 based on the difference in temperature.

A description will now be made of an operation of a turbomolecular pump in accordance with the eighth embodiment of the present invention. In FIG. 10, the thermometer 124*a* and the thermometer 124*b* measure a temperature of introduced gas at the inlet port 40 and the exhaust port 122, and the arithmetic unit 126 then calculates a difference in temperature therebetween. Or, the first thermometer and the second thermometer measure a temperature at the entry 128 and the exit 130 of the water-cooled tube placed close to the rotor blade 12 or around an outer casing 136 in order to water-cool the rotor blade 12, and the arithmetic unit 134 then calculates a temperature difference therebetween.

Based on the temperature difference, the temperature of the rotor blade 12 is then estimated by computing calorie for the introduced gas or water, or by being compared with experimental data calculated in advance, or the like. This allows the temperature of the rotor blade to be measured without affecting a flow of gas.

INDUSTRIAL APPLICABILITY

As described above, according to the present invention, the provision of rotor blade temperature detecting means allows a temperature of a rotor blade to be detected. The temperature of the rotor blade to be monitored, etc. may serve to elongate a lifetime of the rotor blade, to prevent deterioration in reliability caused by a heat generation, and the like.

Further, according to the present invention, the provision of thermometers at a base portion or a flange portion allows a temperature of a rotor blade to be measured without greatly affecting a flow of gas.

Further, according to the present invention, it is so arranged that temperature detecting elements are disposed at a fixing blade, a fixing blade spacer, or a member fixed to a stator to estimate by computation a temperature of a rotor blade. This allows the temperature of the rotor blade to be measured without affecting a flow of gas.

Further, according to the present invention, it is so arranged that the temperature of the rotor blade is estimated by computation based on a variation in lengths between before and after thermal expansion for the rotor blade and a variation in lengths between before and after thermal expansion for a main shaft of the rotor blade. This allows the temperature of the rotor blade to be measured without affecting a flow of gas in a similar manner as above.

Further, according to the present invention, it is so arranged that the temperature of the rotor blade is estimated by computation based on a difference between temperatures at an entry and an exit. This allows the temperature of the rotor blade (12) to be measured without affecting a flow of gas in a similar manner as above.

Further, according to the present invention, it is so arranged as to set a target temperature of the base portion based on the temperature of the rotor blade which is obtained by the rotor blade temperature detecting means, to calculate a difference between the target temperature and the temperature measured in fact at the base portion, and to manage to heat or cool the base portion depending upon the difference. This enables a deposition of generated products to be prevented while attaining a protection of the rotor blade.

Further, according to the present invention, it is so arranged as to include baking temperature setting means, temperature difference calculating means, heating means, and cooling means. This can increase at utmost pressure while attaining a protection of the rotor blade.

Further, according to the present invention, it is so arranged as to include lifetime prediction means, and discriminating means. It can be therefore realized to alarm the timing of an overhaul for the rotor blade or to avoid an abnormal increase in the temperature of the rotor blade.

Further, according to the present invention, it is so arranged that an output signal of rotor blade temperature sensor is compared with a set temperature to make an output of a motor driver variable or to make an r.p.m. of the rotor blade variable, based on the difference therebetween. This allows the output of the motor driver or the r.p.m. of the rotor blade to be adjusted, while maintaining the temperature of the rotor blade within a restricted range, enabling the exhaustion performance to be improved.

Further, according to the present invention, rotor blade driving motor is driven by a motor driver, using computation performed by motor driver output set r.p.m. determining means, driver output switching means, and r.p.m. compensating means. Therefore, when the temperature of the rotor blade is within an allowable value, the driving output and/or the set r.p.m. can be varied to the allowable full extent, thereby enabling the exhaustion performance of the turbomolecular pump P to be exerted to the maximum.

Besides, the driving output is increased while keeping the temperature of the rotor blade within the allowable value even with a change in gas load. This allows a variation in the r.p.m. of the rotor blade driving motor to be lowered, maintaining the exhaustion performance.

Meanwhile, when the temperature of the rotor blade exceeds the allowable value, the driving output of the motor driver may be lowered, the target r.p.m. may be lowered, or the brake, etc. may be applied at the worst, thereby making it possible to lower the temperature of the rotor blade and prevent deterioration of the rotor blade caused by a heat generation.

Further, according to the present invention, it is so arranged that a detection signal detected by an r.p.m. sensor, a motor current sensor, or an axial electromagnet current sensor is fed back to adjust a determination for the driver output and/or the set r.p.m. by the motor driver output set r.p.m. determining means. This enables a prompt adjustment of the driver output and/or adjustment of the set r.p.m., while keeping the temperature of the rotor blade within the allowable value.

Further, according to the present invention, it is so arranged that a determination for the driver output and/or the set r.p.m. by the motor driver output set r.p.m. determining means is carried out in response to an external signal. This arrangement makes it possible to set the driver output or the set r.p.m. of the motor driver higher in advance before the gas load is increased. This allows the exhaustion performance to be maintained even with an abrupt increase of the gas load.

Further, according to the present invention, it is so arranged as to include rotor blade temperature discriminating means and cooling means. It can be therefore realized to more increase a gas flow rate, and to more improve a TMS temperature.

What is claimed is:

1. A turbomolecular pump comprising: a motor; a rotor blade unit having a plurality of axially spaced-apart rotor blades rotated by the motor; a stator opposing the rotor blade unit and having a plurality of fixed blades confronting the rotor blades with a slight gap between confronting fixed blades and rotor blades; an outer casing for containing the motor, the rotor blade unit, the stator and the fixed blades and having a base portion; an inlet port for receiving a gas; an exhaust port for discharging the gas; and rotor blade temperature detecting means for estimating a temperature of the rotor blade unit and comprising one or more radiation thermometers disposed in one of the base portion and a flange portion of the inlet port out of contact with the rotor blade unit.

2. A turbomolecular pump comprising: a motor; a rotor blade unit having a plurality of axially spaced-apart rotor blades rotated by the motor; a stator opposing the rotor blade unit and having a plurality of fixed blades confronting the rotor blades with a slight gap between confronting and rotor blades; fixed blade spacers for supporting one end of the fixed blades and being stacked stepwise in the axial direction of the rotor blades; an outer casing for containing the motor, the rotor blade unit, the stator, the fixed blades and the fixed blade spacers and having a base portion; an inlet port for receiving a gas; an exhaust port for discharging the gas; and rotor blade temperature detecting means comprising one or more temperature detecting elements disposed at least at one of a fixed blade, a fixed blade spacer, and a member fixed to the stator through at least one supporting element formed of a thermally insulating material confronting a main shaft of the rotor blade unit, the main shaft being provided in a space formed at the rotor blade unit side of the stator, one end of which is fixed to the base, and an arithmetic unit for estimating a temperature of the rotor blade unit based on the temperature detected by the one or more temperature detecting elements.

3. A turbomolecular pump comprising: a motor; a rotor blade unit having a plurality of axially spaced-apart rotor blades rotated by the motor; a stator opposing the rotor blade unit and having a plurality of fixed blades confronting the rotor blades with a slight gap between confronting fixed blades and rotor blades; an outer casing for containing the motor, the rotor blade unit, the stator and the fixed blades and having a base portion; and inlet port for receiving a gas; an exhaust port for discharging the gas; and rotor blade temperature detecting means comprising first length measuring means having a first position sensor for measuring a length between the rotor blade unit and the first position sensor in the axial direction of the rotor blade unit and calculating a variation in lengths thereof measured before and after thermal expansion of the rotor blade unit; second length measuring means having a second position sensor for measuring a length between a main shaft of the rotor blade unit and the second position sensor in the axial direction of the main shaft and calculating a variation in lengths thereof measured before and after the thermal expansion of the main shaft; and an arithmetic unit for estimating a temperature of the rotor blade unit based on a difference between the variation in lengths calculated by the second length measuring means and the variation in lengths calculated by the first length measuring means.

4. A turbomolecular pump comprising: a motor; a rotor blade unit having a plurality of axially spaced-apart rotor blades rotated by the motor; a stator opposing the rotor blade unit and having a plurality of fixed blades confronting the rotor blades with a slight gap between confronting fixed blades and rotor blades; an outer casing for containing the motor, the rotor blade unit, the stator and the fixed blades and having a base portion; an inlet port for receiving a gas; an exhaust port for discharging the gas; a water-cooled tube for cooling the rotor blade unit; and rotor blade temperature detecting means for determining by computation a temperature of the rotor blade unit based on one of a difference between a temperature of introduced gas at the inlet port and discharged gas at the exhaust port and a difference between a temperature at an entry and an exit of the water-cooled tube.

5. A turbomolecular pump according to any one of claims 1, 2, 3, or 4; further comprising base temperature setting means for setting a target temperature of the base of the outer casing based on the temperature of the rotor blade unit determined by the rotor blade temperature detecting means so that the rotor blade unit is maintained within a desired temperature range; temperature difference calculating means for calculating a difference between the target temperature set by the base temperature setting means and an actual measured temperature of the base; and temperature control means for controlling the temperature of the base by heating or cooling the base in response to an output signal of the temperature difference calculating means.

6. A turbomolecular pump according to any one of claims 1, 2, 3, or 4; further comprising baking means for heating for a predetermined time period and then cooling at least one of the turbomolecular pump, a pipe connecting the turbomolecular pump to an external device and having one end connected to the inlet port, and an external device connected to the other end of the pipe, the baking means including means for conducting the heating and cooling while the turbomolecular pump is operated without introducing gas to the inlet port thereof, and comprising baking temperature setting means for setting a target temperature of the rotor blade unit for heating; temperature difference calculating means for calculating a difference between the target temperature of the rotor blade unit set by the baking temperature setting means and the temperature of the rotor blade unit determined by the rotor blade temperature detecting means; heating means for heating for a predetermined time period at least one of the outer casing, the base of the turbomolecular pump, the pipe, and the external device in response to an output signal of the temperature difference calculating means so that the rotor blade unit is maintained within a desired temperature range; and cooling means for cooling at least one of the outer casing, the base, the pipe, and the external device a predetermined time after heating has been performed by the heating means.

7. A turbomolecular pump according to any one of claims 1, 2, 3, or 4; further comprising lifetime prediction means for predicting one of a lifetime of the rotor blade unit and a deposition volume of generated products deposited on an internal surface of a pump member by analyzing a relationship between rotor blade temperature, pump operation time and pump pressure, including when the temperature of the rotor blade unit as determined by the rotor blade temperature detecting means exceeds a predefined allowable value, how long the temperature of the rotor blade unit exceeds the predefined allowable value, and the pressure within a pipe having one end connected to the inlet port and another end connected to an external device, and outputting a corresponding signal; and discriminating means for comparing the signal output by the lifetime prediction means with a predefined set value and for performing one of generating an alarm when the signal output by the lifetime prediction mean exceeds the set value and varying a target temperature of the base temperature and a target temperature of the rotor blade unit based on a difference between the signal output by the lifetime prediction means and the predefined set value.

8. A turbomolecular pump according to any one of claims 1, 2, 3, or 4; further comprising a motor driver for driving the motor to rotate the rotor blade unit; means for comparing the temperature of the rotor blade as determined by the rotor blade temperature detecting means with a preset temperature; and means for varying one of an output of the motor driver and an r.p.m. value of the rotor blade unit based on the difference therebetween.

9. A turbomolecular pump according to any one of claims 1, 2, 3, or 4; further comprising a motor driver for driving the motor; motor driver output set r.p.m. determining means for comparing the temperature of the rotor blade as determined by the rotor blade temperature detecting means with a preset temperature and, based on the difference therebetween, determining one of a maximum driver output value of the motor driver and a maximum r.p.m. value of the rotor blade; and at least one of driver output switching means for adjusting a driving output of the motor driver in a variable manner or stopping the motor in response to an output signal of the motor driver output set r.p.m. determining means, and r.p.m. compensating means for comparing the set r.p.m. calculated by the motor driver output set r.p.m. determining means with an output signal of an r.p.m. sensor for detecting an r.p.m. of the rotor blade unit driving motor and driving the motor driver based on the difference therebetween.

10. A turbomolecular pump according to claim 9; further comprising a feedback circuit for adjusting the one of the driver output value or the r.p.m. value set by the motor driver output set r.p.m. determining means and comprising an r.p.m. sensor for detecting an r.p.m. of the rotor blade unit driving motor to produce a detection signal that is fed back as a control signal, a motor current sensor for detecting a motor current of the motor for driving rotor blade unit, and an axial electromagnet current sensor for detecting a current of an axial electromagnet that causes the rotor blade unit to magnetically float.

11. A turbomolecular pump as claimed in claim 10; wherein the motor driver output set r.p.m. determining means includes means for determining the one of the driver output value or the r.p.m. value of the rotor blade unit based on an external signal predicting a change in a load flow rate from an external device connected to the inlet port of the turbomolecular pump.

12. A turbomolecular pump as claimed in any one of claims 1, 2, 3, or 4; further comprising rotor blade temperature discriminating means for discriminating whether or not the temperature of the rotor blade unit determined by the rotor blade temperature detecting means exceeds a predefined allowable value; and cooling means for cooling a surrounding area of the rotor blade unit or a surrounding area of the outer casing based on an output of the rotor blade temperature discriminating means.

13. A pump comprising: a motor; a rotor rotated by the motor; a stator opposing the rotor; a case for containing the motor, the rotor and the stator; an inlet port for receiving a gas and an exhaust port for discharging the gas; and rotor temperature detecting means disposed in the case for estimating a temperature of the rotor without contacting the rotor.

14. A pump according to claim 13; wherein the rotor has a plurality of axially spaced-apart blades; and the stator has a plurality of axially spaced-apart fixed blades, the fixed blades confronting the rotor blades with a small gap between confronting rotor and fixed blades.

15. A pump according to claim 14; wherein the rotor temperature detecting means comprises a radiation detector disposed on one of the case proximate the rotor or a fixed blade for detecting a temperature and outputting a corresponding signal, and a circuit for estimating the temperature of the rotor based on the signal output by the radiation detector and a temperature gradient between the radiation detector and the rotor.

16. A pump according to claim 14; further comprising fixed blade spacers for supporting one end of the fixed blades and being stacked step-wise in the axial direction of the rotor; wherein the rotor temperature detecting means comprises a radiation detector disposed on a fixed blade spacer for detecting a temperature and outputting a corresponding signal, and a circuit for estimating the temperature of the rotor based on the signal output by the radiation detector and a temperature gradient between the radiation detector and the rotor.

17. A pump according to claim 13; wherein the rotor temperature detecting means comprises a position detector for detecting a position of a part of the rotor, and a circuit for comparing a difference in position of the part of the rotor before and during thermal expansion of the rotor and estimating a temperature of the rotor based on the difference.

18. A pump according to claim 13; wherein the rotor temperature detecting means comprises a first radiation detector for detecting a temperature of a gas introduced at the inlet port, a second radiation detector for detecting a temperature of a gas discharged from the exhaust port, and a circuit for comparing the detected temperatures and estimating the temperature of the rotor based on the difference therebetween.

19. A pump according to claim 13; further comprising means for varying a rotating speed of the rotor based on an output of the rotor temperature detecting means so that the rotor temperature is maintained within a preset temperature range.

* * * * *